US006234384B1

(12) United States Patent
Capy et al.

(10) Patent No.: US 6,234,384 B1
(45) **Date of Patent: *May 22, 2001**

(54) REINFORCING DEVICE OF A FOLDED PACKAGE FOR CONVEX OBJECTS

(76) Inventors: Gilbert Capy, La Botte, F-69640, Jarnioux (FR); Akiva Buchberg, 5030 Pine Tree Dr., Miami Beach, FL (US) 33140

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/142,603

(22) PCT Filed: May 27, 1997

(86) PCT No.: PCT/FR97/00923

§ 371 Date: Sep. 11, 1998

§ 102(e) Date: Sep. 11, 1998

(87) PCT Pub. No.: WO97/45331

PCT Pub. Date: Dec. 4, 1997

(30) Foreign Application Priority Data

May 28, 1996 (FR) ..... 96 06825

(51) Int. Cl.[7] ..... B65D 65/12

(52) U.S. Cl. ..... 229/87.03; 156/519; 156/522; 229/87.08; 229/938

(58) Field of Search ..... 229/87.01, 87.03, 229/87.08, 938; 156/519, 522

(56) References Cited

U.S. PATENT DOCUMENTS

| | | | | |
|---|---|---|---|---|
| Re. 35,241 | * | 5/1996 | Capy et al. | 229/87.03 |
| 1,846,585 | * | 2/1932 | Clark | 229/87.03 |
| 1,948,615 | * | 2/1934 | Clark | 229/87.03 |
| 2,387,217 | * | 10/1945 | Scott | 229/87.05 |
| 2,586,078 | * | 2/1952 | O'Malley | 229/87.03 |
| 3,668,049 | * | 6/1972 | Silfverlin | 229/87.01 |
| 4,881,646 | * | 11/1989 | Weber | 229/87.08 |
| 5,131,586 | * | 7/1992 | Capy | 229/87.03 |
| 5,518,167 | * | 5/1996 | Capy | 229/87.03 |
| 5,580,625 | * | 12/1996 | Capy et al. | 229/87.03 |

* cited by examiner

*Primary Examiner*—Stephen P. Garbe
(74) *Attorney, Agent, or Firm*—Pitney, Hardin, Kipp & Szuch, LLP

(57) ABSTRACT

The device is constituted by rectangular reinforcement pieces made from a strip of semi-rigid material, fixed on a thin flexible sheet on the median portion of the zones and mutually articulated by hinges located astride the folds separating the zones.

6 Claims, 2 Drawing Sheets

REINFORCING DEVICE OF A FOLDED PACKAGE FOR CONVEX OBJECTS

CROSS-REFERENCE TO RELATED APPLICATIONS

This application is a 35 U.S.C. 371 application of PCT/FR97/00923 filed Mar. 27, 1997.

BACKGROUND OF THE INVENTION

1. Field of the Invention

The present invention relates to a reinforcing device of a package for convex objects, which package is made from a folded thin sheet, the folds of which are fixed at their ends so as to impart to it resistance to vertical load.

2. Description of the Related Art

A package for convex objects, which is made from a thin, flexible sheet which, in one of its applications, makes it possible to eat a round sandwich leaving the package around the sandwich in order to collect any runs and to fold it over as the sandwich is eaten, is known from patents FR-A-2595666 and FR-A-2628719. The flexibility of the sheet makes it possible to unfold manually the folds around the convex object; indeed, during unfolding of the folds with one hand, the other hand holds the convex object by gripping it between the fingers; the more flexible the film, the less need there is to grip the convex object to hold it between the fingers; when this convex object is fragile like, for example, sandwiches of an essentially cylindrical shape generated by revolution which are produced in fast-food catering and made from brioche-type bread, there is a risk of crushing the sandwich during unfolding of the folded package; the counterpart of the flexibility of the sheet used is that the package does not protect the sandwich against crushing during transport. This shortcoming led to the idea of protecting the sandwich, when it is of cylindrical shape, with a board ring which surrounds it over its entire lateral wall, the whole then being surrounded by a thin sheet of paper. The disadvantage of such a device is that its implementation is very time-consuming and that, when it is associated with the folded package as described in the patent FR-A-352676037, it is difficult to remove the board ring without removing the folded package which, therefore, no longer performs its function of protection against runs. Within the scope of development of the folded package, attempts were made to fix the reinforcing strip directly to the thin sheet in the direction perpendicular to the folds; but the thickness of the reinforcement is limited after a short time because it soon becomes impossible to unfold the reinforcement without crushing the sandwich. To overcome this difficulty, an attempt was then made in the patent FR-A-2734791, while retaining a reinforcing strip fixed to the sheet, to leave it pre-unfolded with equal folds while the folded part of the package is folded as described previously; the problem is that, when it is associated with a flat sheet, as in the patent FR-A-2676037, which makes it possible to protect the upper and lower openings left by the edges of the folded part, it is no longer possible to stack them appropriately so as to reduce the volume they occupy during transport of the folded package.

BRIEF SUMMARY OF THE INVENTION

The object of the invention is to produce a device which makes it possible to obtain a folded package which has good resistance to vertical load and is easy to unfold and easy to store when it is folded up for transport.

To this end, rectangular reinforcements originating from a strip of semi-rigid material, which are cut, positioned and fixed using appropriate means, are associated with the successive zones separated by a fold.

The invention also relates to devices for positioning, folding and fixing the reinforcing means of the package.

DETAILED DESCRIPTION OF THE INVENTION

Figure 1:
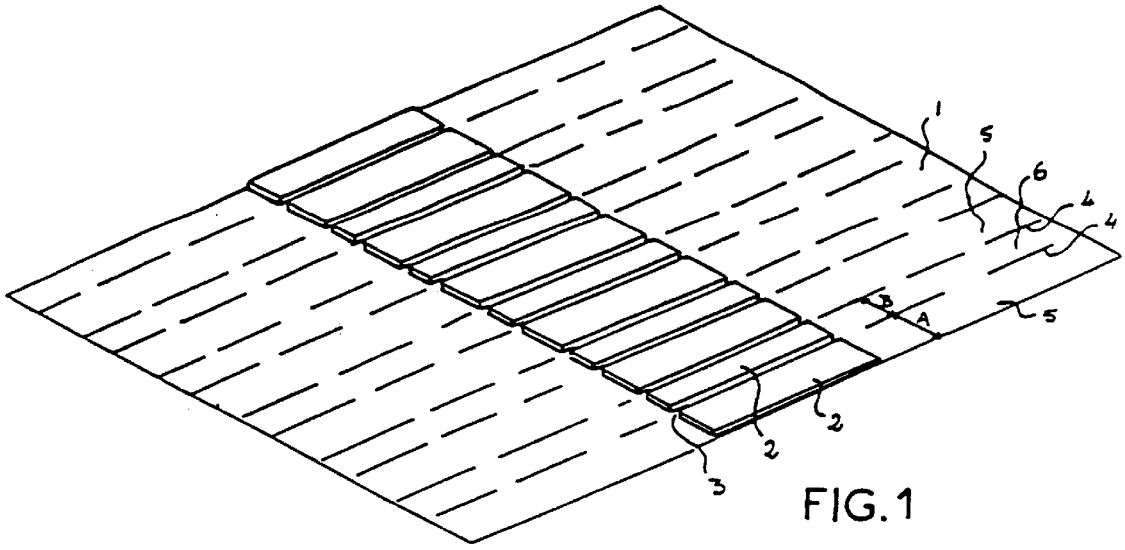
FIG. 1 shows the reinforcing device of the thin sheet constituting the package before it has been folded and the end of the folds has been fixed.

The device consists in associating with the flexible sheet 1 (FIG. 1), instead of a continuous reinforcing strip, a discontinuous strip consisting of rectangular reinforcements 2 positioned in proximity to one another and articulated with one another by a hinge 3 formed by the thin sheet 1 which interconnects them. As the folding consists of successive rectangular zones 5 and 6 separated from one another by folds 4 forming an integral part of the hinge 3, the rectangular reinforcements 2 are positioned within these rectangular zones 5 and 6 and are folded up on one another in the same manner as the folds 4 of the thin sheet. When the successive rectangular reinforcements 7 and 8 (FIG. 2) are folded up on one another in such a manner that these two successive rectangular reinforcements 7 and 8 are in direct contact, it is necessary that the distance 9 that separates them is greater than or equal to their combined thickness 10 and 11, otherwise the portion of thin sheet serving as a hinge 12 is subjected to tensile stress which may either prevent the positioning of the rectangular reinforcements 7 and 8 on one another or cause stretching or tearing of the part of thin sheet forming the hinge 12; on the other hand, when the fold 13 is made in such a manner that it is the thin sheet 14 which is in contact with itself and the rectangular reinforcements 8 and 15 are positioned on the outer side, they may be positioned one against another.

Figure 3:
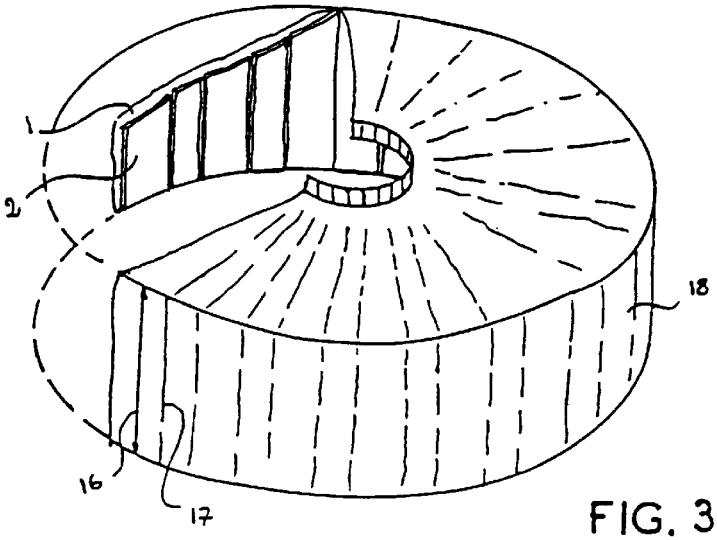
FIG. 3 shows an exploded perspective view of the reinforcing device when it is unfolded around the convex object (not shown).

The positioning of the rectangular reinforcements 2 (FIG. 1) in relation to one another is one of the main problems solved by the device forming the subject of the invention, making it possible to position the rectangular reinforcements 2 correctly in relation to one another. These rectangular reinforcements 2 (FIG. 3) have a height 16 consistent with the height of the convex object to be protected and in particular, by way of non-limiting example, of the sandwich of essentially cylindrical shape generated by revolution described above; when the package produced in this manner is unfolded (FIG. 3), the succession of rectangular reinforcements 2 interconnected by the hinges 17 of the flexible sheet 1 constitutes a series of dihedra essentially forming a ring 18; when vertical loads are applied to this ring 18 positioned on a horizontal plane, the buckling of the rectangular reinforcements 2 under the load is limited by the thin sheet forming the hinge 17 being placed under horizontally orientated tensile stress; the resistance of this ring 18 is limited, among other things, by the resistance of the thin sheet 1 which will ultimately tear under the action of the tension when the load becomes too great; the rectangular reinforcement 2 can then bend.

Figure 4:
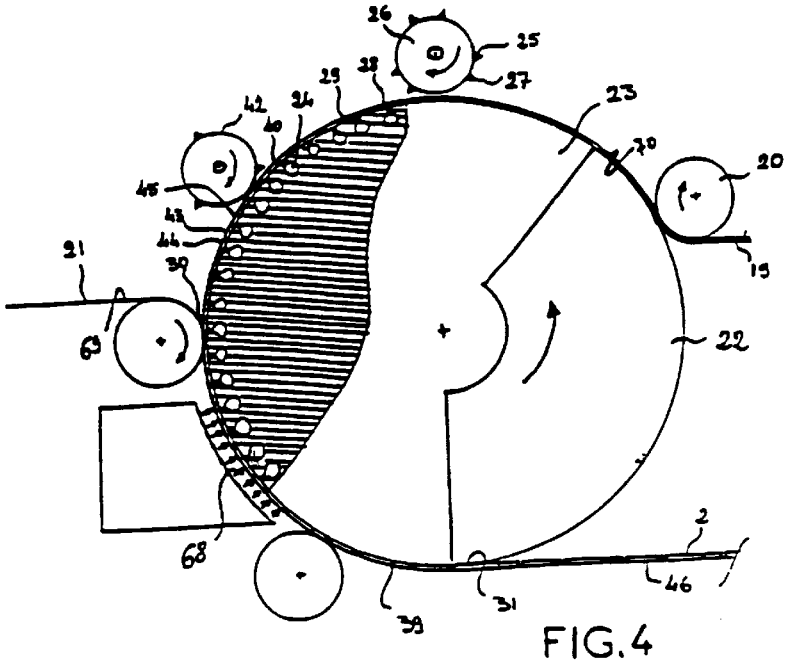
FIG. 4 shows an exploded elevation view of the essential components of the device for cutting, positioning and fixing the elements constituting the reinforcing device according to the invention.

A manner of envisaging the positioning of the reinforcement rectangles 2 (FIG. 4) consists in starting from a coil of semi-rigid material, the width of which corresponds to the height 16 (FIG. 3) of the rectangular reinforcement; this strip 19 (FIG. 4) is drawn by rollers 20 at a speed slightly slower than the unwinding speed of the strip of thin sheet 21 onto which it is going to be fixed. The strip 19 of semi-rigid material is then drawn by a support cylinder 22 rotating at a tangential speed equal to the unwinding speed of the strip of thin sheet 21; the strip 19 of semi-rigid material is held on the support cylinder 22 by a system 23 of suction holes or slits 24 which allow it to slide slightly taking account of the difference in the unwinding speed between the tangential speed of the support cylinder 22 and that of the strip 19. The support cylinder 22 serves as an anvil for knives 25 which are integral with a cutting cylinder 26 and the edge 27 of which is brought to be tangent to the support cylinder 22 along its generating lines. The position of the knives 25 on the cutting cylinder 26 and its speed are determined so as to cut rectangular reinforcements 2, the width of which is such that they are adapted alternately to the width of each of the thin sheet zones 5 and 6 (FIG. 1) separating two successive folds 4 of the package when it is folded.

Figure 2:
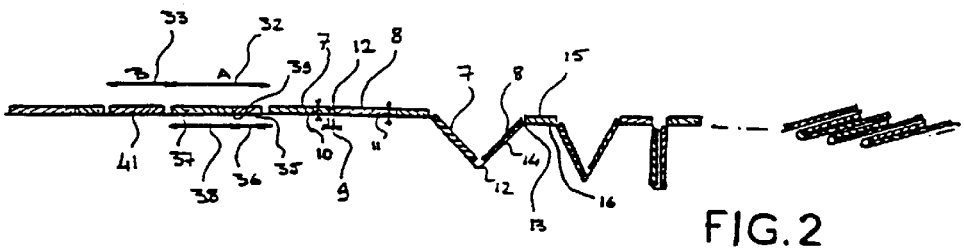
FIG. 2 shows a section of the thin sheet in line with the reinforcing device according to FIG. 1 with the successive stages which make it possible to fold it up.

In general, the tangential speed of the edge 27 (FIG. 4) of the knives 25 is equal or close to the tangential speed of the support cylinder 22 according to the degree of wear of the knives 25; in any case, the points of contact of the edge 27 of the knives 25 on the surface of the support cylinder 22 are always in the same places, the suction holes or slits 24 serving to hold the rectangular reinforcements 2 being situated between these points of contact. Taking account of the difference in speed between the strip 19 and the surface of the support cylinder 22, as soon as the rectangular reinforcement 28 is cut, it is drawn at the speed of the support cylinder 22 and a space is thus created between two successive rectangular reinforcements 28 and 29. The strip consisting of a thin sheet 21 can then be brought to be tangent to the support cylinder 22 in the area containing the rectangular reinforcements 30 which are applied accurately to the thin sheet 21 and fixed thereto using known means; then, the suction is turned off at the holes or slits 24 of the support cylinder 22, which held the rectangular reinforcements 31 in place, and a thin sheet equipped with rectangular reinforcements as shown by FIG. 1 is released. It is then possible to proceed to the folding.

Figure 5:
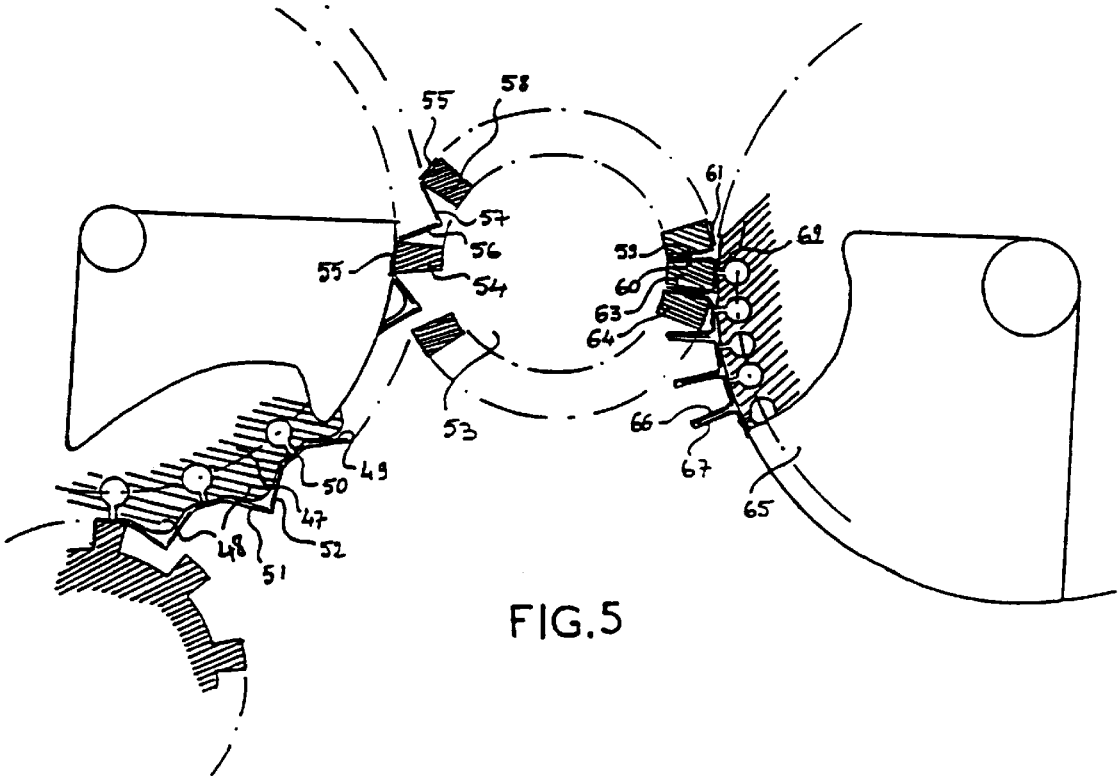
FIG. 5 shows a view of the main components, in an exploded elevation, of the device for folding the thin sheet reinforced according to the stages in FIG. 2 and produced using the device in FIG. 4.

In a preferred embodiment of the invention, the folding takes place according to a process deriving directly from European Patent 0 528 920; the zones 5 and 6 located on either side of a fold 4 have widths A 32 and B 33 with A>B; the zones have a width of A 32 and B 33 alternately; the zone 34 (FIG. 2) of width A 32 is divided into a zone 35 of width A-B 36 and a zone 37 of width B 38; these two zones 34 and 35 are separated by a fold 39, the two zones 37 and 41 of width B 38 and 33 being located side by side; the rectangular reinforcement 40 comprises a cut in line with this fold 39; the cut in the rectangular reinforcement 40 (FIG. 4) of width A is made on the support cylinder 22 by a second cutting cylinder 42; as the rectangular reinforcement 40 has already been separated from the strip 19 by the cut made by the cutting cylinder 26, the two pieces 44 and 45 obtained by the cut 43 remain essentially side by side; this does not cause a problem insofar as the part 44 of width A-B is situated at the front of the rectangular reinforcement 40 of the zone of width A seen in the direction of movement; the cut in line with the fold 39 can also be made by knives positioned on the cutting cylinder 26; under these conditions, a space is formed between the two parts of the reinforcement. The sheet 46 equipped with its rectangular reinforcements 2 passes over a pre-shaping wheel 47 (FIG. 5) comprising teeth 48, the rectangular reinforcements 49 being situated on the same side as the wheel 47; the zone 50 of width A-B is positioned at the bottom of the tooth 48 and the two zones 51 and 52 of width B cover the tooth 48 which is in the shape of an inverted V. A wheel 53 for closing up the folds, made up of bars 54, takes the pre-shaped thin sheet with its rectangular reinforcements; the zones 55 of width A-B are positioned at the top of the bars 54 while the two zones 56 and 57 of width B are positioned in the hollow formed by two successive bars 54 and 58; the rectangular reinforcements are then on the outer side of the wheel 53 for closing up the folds; when the bars 54 move closer together, the zones 59 and 60 of width B move closer together and the rectangular reinforcements are superposed on one another without difficulty on account of the space (FIG. 2) left between two successive rectangular reinforcements 7 and 8 at the time of cutting, and the zones 61 and 62 of width A-B are positioned side by side; it is nevertheless necessary that the zones of width B have sufficient play when the bars 63 and 64 are moved closer together in order that they can be released easily on account of their rigidity. The zones 61 and 62 of width A-B are then transferred onto the cylinder 65 for gathering the folds with the rectangular reinforcement turned towards the latter 65, the successive zones 66 and 67 of width B forming a projection, and the corresponding rectangular reinforcements being situated on the inside of the projection; laying down of the folds can then be carried out with the aid of a cylinder comprising, at the level of the rectangular reinforcements, a reduced diameter taking account of the various thicknesses of rectangular reinforcement which are superposed on one another and which constitute a significant extra thickness.

A manner of fixing the rectangular reinforcements on the thin sheet consists in making use of a rectangular reinforcement coated with a thin layer of heat-sealing material located on the outer side 70 in relation to the support cylinder 22; the thin sheet can also be coated with a thin layer of heat-sealing material on the side 69 facing the rectangular reinforcement; fixing of the reinforcement is then performed at the time of application of the flexible sheet to the rectangular reinforcement by heating with hot air 68 the face of the flexible sheet opposite that which is coated.

What is claimed is:

1. A reinforced package having a reinforced resistance on vertical load and formed of an approximately annular-shaped reinforcement device of approximately constant height when deployed comprising a thin sheet folded along successive areas having a width A and B respectively with A larger than B whereby the successive areas are separated by respective folds in the thin sheet creating respective hinges and are reinforced in a median portion of the thin sheet by rectangular reinforcing pieces made of a semi-rigid material and joined together by respective hinges made from the thin sheet with such reinforcing pieces being sufficiently spaced apart on opposite sides of the respective hinges.

2. The package according to claim 1, wherein when the package is folded adjacent reinforcing pieces are in direct contact and are spaced apart at a distance which is greater than the respective total thicknesses of the successive reinforcing pieces.

3. The package according to claim 2, wherein reinforcing pieces having a width A have a side parallel to the hinge at a distance therefrom which is equal to a difference of the width between A and B.

4. Device for assembling the reinforced package according to claim 1, comprising a support cylinder which rotates at a tangential speed for driving a strip made of a semi-rigid material and being fitted with a suction device, a cutting cylinder having knives for cutting the strip into successive rectangular reinforcing pieces which are placed on the thin sheet which is unwound at an unwinding speed so as to form a composite sheet which is kept in place on the support cylinder by the suction device and with an unwinding speed of the strip being at a speed slightly less than the tangential speed of the support cylinder.

5. The device according to claim 4, which further includes a second cutting cylinder for cutting reinforcement pieces having a width A on its right side adjacent the hinge.

6. The device according to claim 4, which further includes coating either the rectangular reinforcing pieces or the thin sheet with a hot sealing material so as to affix one to the other.

* * * * *